US008418405B2

(12) United States Patent
Yoshida et al.

(10) Patent No.: US 8,418,405 B2
(45) Date of Patent: Apr. 16, 2013

(54) AUTOMATIC OPENING AND CLOSING APPARATUS FOR VEHICLE

(75) Inventors: Yasushi Yoshida, Kiryu (JP); Junichi Busujima, Kiryu (JP); Takashi Takizawa, Kiryu (JP); Takeshi Miyagawa, Ueda (JP); Seiichi Miyamoto, Ueda (JP)

(73) Assignees: MITSUBA Corporation, Kiryu-shi, Gunma (JP); Johnan Manufacturing, Inc., Nagano (JP)

( * ) Notice: Subject to any disclaimer, the term of this patent is extended or adjusted under 35 U.S.C. 154(b) by 242 days.

(21) Appl. No.: 12/933,242

(22) PCT Filed: Mar. 19, 2009

(86) PCT No.: PCT/JP2009/055490

§ 371 (c)(1), (2), (4) Date: Sep. 17, 2010

(87) PCT Pub. No.: WO2009/116640

PCT Pub. Date: Sep. 24, 2009

(65) Prior Publication Data

US 2011/0023369 A1 Feb. 3, 2011

(30) Foreign Application Priority Data

Mar. 19, 2008 (JP) ..... 2008-071765

(51) Int. Cl.
*E05F 11/44* (2006.01)
*E05F 11/46* (2006.01)

(52) U.S. Cl.
USPC ..... 49/351; 49/348; 49/349; 49/350

(58) Field of Classification Search ..... 49/348, 49/349, 350, 351; 296/56
See application file for complete search history.

(56) References Cited

U.S. PATENT DOCUMENTS 3,900,965 A * 8/1975 Mummert ..... 49/103
4,000,581 A * 1/1977 Fukumoto et al. ..... 49/103

(Continued)

FOREIGN PATENT DOCUMENTS

CN 1928307 A 3/2007
JP 416285 2/1992

(Continued)

OTHER PUBLICATIONS

The International Search Report from corresponding International Application No. PCT/JP2009/055490 dated Apr. 28, 2009 (4 pages).

(Continued)

*Primary Examiner* — Katherine Mitchell
*Assistant Examiner* — Shiref Mekhaeil
(74) *Attorney, Agent, or Firm* — McCormick, Paulding & Huber LLP

(57) ABSTRACT

A speed reducer (32) including a gear case (33) is attached in an electric motor, and a pinion is provided to an output shaft (35) protruding from the gear case (33). A base portion (33*a*) protruding in a diametrical direction is provided to the gear case (33) and a support shaft is mounted to the base portion (33*b*). A sector gear (42) is fixed to a base end of a lift arm (24), and the sector gear (42) is swingably supported by the support shaft and meshed with the pinion. In addition, a groove portion (42*c*) in a circular arc shape is provided to the sector gear (42), and a gear cover (51) is fixed to the gear case (33) by a bolt (58) penetrating the groove portion (42*c*) and a bolt (54) disposed on an outer periphery side than the sector gear (42), and the gear cover (51) covers a mesh portion of the pinion and the sector gear (42) and presses the sector gear (42) toward the gear case (33).

12 Claims, 13 Drawing Sheets

U.S. PATENT DOCUMENTS

| | | | | |
|---|---|---|---|---|
| 4,905,413 | A * | 3/1990 | Kuki et al. | 49/362 |
| 4,986,029 | A * | 1/1991 | Richter | 49/349 |
| 5,085,004 | A * | 2/1992 | Beauprez | 49/138 |
| 5,101,596 | A * | 4/1992 | Moore | 49/351 |
| 5,111,620 | A * | 5/1992 | Lau et al. | 49/502 |
| 5,513,468 | A * | 5/1996 | Diestelmeier | 49/375 |
| 5,595,025 | A * | 1/1997 | MacPhail-Fausey | 49/351 |
| 5,653,144 | A * | 8/1997 | Fenelon | 74/411 |
| 5,715,630 | A * | 2/1998 | Szerdahelyi et al. | 49/351 |
| 6,075,298 | A * | 6/2000 | Maue et al. | 310/12.14 |
| 6,114,820 | A * | 9/2000 | Nishigaya | 318/466 |
| 6,320,335 | B1 * | 11/2001 | Saitou | 318/9 |
| 6,530,175 | B2 * | 3/2003 | Sato et al. | 49/138 |
| 7,810,281 | B2 * | 10/2010 | Warren et al. | 49/349 |
| 7,849,634 | B2 * | 12/2010 | Subinas | 49/349 |
| 8,061,083 | B2 * | 11/2011 | Shirai et al. | 49/349 |
| 2003/0167695 | A1 * | 9/2003 | Regnier et al. | 49/351 |
| 2005/0198903 | A1 * | 9/2005 | Isomura et al. | 49/351 |
| 2008/0127563 | A1 * | 6/2008 | Tooker | 49/349 |
| 2008/0168714 | A1 * | 7/2008 | Watanabe et al. | 49/349 |
| 2010/0107502 | A1 * | 5/2010 | Okada et al. | 49/349 |
| 2010/0242364 | A1 * | 9/2010 | Magro | 49/31 |
| 2011/0023368 | A1 * | 2/2011 | Mizutani et al. | 49/349 |
| 2011/0314739 | A1 * | 12/2011 | Kaburaki | 49/70 |
| 2011/0314740 | A1 * | 12/2011 | Mori et al. | 49/349 |
| 2012/0017512 | A1 * | 1/2012 | Lee et al. | 49/349 |

FOREIGN PATENT DOCUMENTS

| | | | |
|---|---|---|---|
| JP | 11036698 | A | 2/1999 |
| JP | 11062378 | A | 3/1999 |
| JP | 11336420 | A | 12/1999 |
| JP | 2001090796 | A | 4/2001 |

OTHER PUBLICATIONS

Office Action and English Translation received in corresponding Chinese Patent Application No. 200980109811.2 dated Sep. 29, 2012.

* cited by examiner

AUTOMATIC OPENING AND CLOSING APPARATUS FOR VEHICLE

CROSS REFERENCE TO RELATED APPLICATIONS

This application is entitled to the benefit of and incorporates by reference essential subject matter disclosed in International Patent Application No. PCT/JP2009/055490 filed on Mar. 19, 2009 and Japanese Patent Application No. 2008-071765 filed Mar. 19, 2008.

TECHNICAL FIELD

The present invention relates to an automatic opening and closing apparatus for vehicle which automatically opens and closes an opening and closing member provided to a vehicle.

BACKGROUND ART

Throughout a vehicle such as an automobile, opening and closing members such as window glasses to be mounted to doors and a tailgate (back door) to be mounted to the rear end of the auto body are mounted. Also, to ease opening and closing operations of these opening and closing members, vehicles mounting automatic opening and closing apparatuses such as a power window apparatus and a power tailgate apparatus have been developed.

As such an automatic opening and closing apparatus, for example, like a power window apparatus including a regulator of an X-arm type, an arm-driving type automatic opening and closing apparatus has been known, in which an opening and closing member is coupled to a tip of a drive arm swingably supported to an auto body or a door by a support shaft so that the opening and closing member is opened and closed by driving the drive arm to swing by an electric motor. In this case, a gear case which houses a worm gear mechanism is attached to the electric motor, and a drive gear fixed to an output shaft is disposed to an outer surface of the gear case, and a driven gear provided to a base end of the drive arm is meshed with the drive gear. In this manner, when the electric motor is activated, rotation of the electric motor is transmitted from the drive gear to the driven gear and the drive arm is swung together with the driven gear.

Meanwhile, as such an automatic opening and closing apparatus, one in which a bracket is fixed to a gear case and a support shaft is supported by this bracket to keep a mesh pitch of a drive gear and a driven gear has been known. However, even in such a configuration, when load is applied from an opening and closing body to a drive arm in a direction inclined with respect to the support shaft, the mesh accuracy is degraded as the driven gear is inclined with respect to the drive gear, and thus there have been abnormal noise generated from the meshing portion and a lowering of activation efficiency of the automatic opening and closing apparatus.

Therefore, for example, in the automatic opening and closing apparatus described in Japanese Patent Application Laid-Open Publication No. 2001-90796, by using a part of a bracket, a pressing portion which abuts a side surface of the driven gear to presses the driven gear to the gear case side so that an inclination of the driven gear is suppressed by the pressing portion and meshing between the drive gear and driven gear is maintained.

DISCLOSURE OF THE INVENTION

An automatic opening and closing apparatus for vehicle of the present invention is an automatic opening and closing apparatus for vehicle which automatically opens and closes an opening and closing body mounted on a vehicle, the automatic opening and closing apparatus for vehicle including: an electric motor having a rotating shaft; a gear case attached to the electric motor; a worm gear mechanism which reduces speed of rotation of the rotating shaft and outputs the same from an output shaft; a drive gear provided to the output shaft and rotated together with the output shaft, as being arranged outside the gear case; a driven gear having a groove portion in a circular arc shape about a shaft center and engaged to the drive gear, as being swingably supported by a support shaft integrally provided with the gear case; a drive arm integrally provided with the driven gear and coupled to the opening and closing body at its tip so as to be swung together with the driven gear so that the opening and closing body is opened and closed; and a gear cover fixed to the gear case by a first fastening member penetrating the groove portion and a second fastening member arranged on an outer periphery side of the driven gear, the gear cover covering a mesh portion of the drive gear and the driven gear and abutting a side surface of the driven gear.

In the automatic opening and closing apparatus for vehicle of the present invention, the drive arm and the driven gear are separately formed and a base end of the drive arm is fixed to the driven gear and swingably supported by the support shaft.

In the automatic opening and closing apparatus for vehicle of the present invention, a pressing portion extended in a circular arc shape about the support shaft and protruding toward the driven gear is provided to the gear cover, and the pressing portion is abutted with the side surface of the driven gear.

In the automatic opening and closing apparatus for vehicle of the present invention, a tip of the support shaft is supported by the gear cover.

In the automatic opening and closing apparatus of the present invention, the first and second fastening members are bolts disposed on the gear cover side and screw-coupled to nuts disposed on the gear cover side, and tips of the bolts are fixing portions to the vehicle, as penetrating the nuts.

In the automatic opening and closing apparatus for vehicle of the present invention, a bracket is integrally fixed to the gear case, and the driven gear is pivotally supported by a support shaft provided to the bracket, and also, the gear cover is fixed to the bracket by the first fastening member.

In the automatic opening and closing apparatus for vehicle of the present invention, the bracket is fixed to the gear case as the gear cover and the driven gear are being assembled and unitized.

In the automatic opening and closing apparatus for vehicle of the present invention, the opening and closing body is a window glass mounted to be openable and closable in a vertical direction to a door of the vehicle, the electric motor is arranged inside the door having an axis direction of the drive gear toward a thickness direction of the door, and the drive arm is swung in the vertical direction inside the door to open and close the window glass.

An automatic opening and closing apparatus for vehicle of the present invention is an automatic opening and closing apparatus for vehicle which automatically opens and closes an opening and closing body mounted on a vehicle, the automatic opening and closing apparatus for vehicle including: an electric motor having a rotating shaft; a gear case attached to the electric motor; a worm gear mechanism which reduces speed of rotation of the rotating shaft and outputs the same from an output shaft; a drive gear provided to the output shaft and rotated together with the output shaft, as being disposed outside the gear case; a driven gear having a groove portion in a circular arc shape about a shaft center and meshed to the drive gear, as being swingably supported by a support shaft integrally provided with the gear case; a drive arm integrally provided with the driven gear and coupled to the opening and closing body at its tip so as to be swung together with the driven gear so that the opening and closing body is opened and closed; and a gear cover locked to the gear case on an outer periphery side of the driven gear and also fixed to the gear case by a fastening member penetrating the groove portion, the gear cover supporting the support shaft and the output shaft, covering a mesh portion of the drive gear and the driven gear, and abutting a side surface of the driven gear.

In the automatic opening and closing apparatus for vehicle of the present invention, the gear cover abuts the side surface of the driven gear at a pressing portion on cover side protruding toward the driven gear, and a pressing portion on case side protruding toward the driven gear and abutting the side surface of the driven gear is provided to the gear case.

In the automatic opening and closing apparatus for vehicle of the present invention, the pressing portion on case side and the pressing portion on cover side oppose each other interposing the driven gear.

According to the present invention, the gear cover for suppressing an inclination of the driven gear is fixed to the gear case by the first fastening member penetrating the groove portion in a circular arc shape provided to the driven gear and the second fastening member disposed on the outer periphery side of the driven gear, and the gear cover is supported at its both sides to the gear case interposing the mesh portion between the drive gear and the driven gear, thereby surely preventing an inclination of the driven gear by the gear cover. In this manner, mesh accuracy of the drive gear and the driven gear are increased and generation of abnormal noise from the mesh portion is prevented, and also, activation efficiency of an automatic opening and closing apparatus can be increased. Also, the opening and closing body can be a tailgate mounted to a window glass provided to a door of a vehicle and/or a backend portion of the vehicle.

According to the present invention, the drive arm and the driven arm are separately formed and thus drive arms having different shapes can be used in accordance with specifications of the vehicle. In this manner, versatility of the automatic opening and closing apparatus can be increased.

According to the present invention, the driven gear is pressed by the pressing portion in a circular arc shape provided to the gear cover, and thus an inclination of the driven gear is surely suppressed and the mesh accuracy of the drive gear and the driven gear can be further increased.

According to the present invention, the tip of the support shaft is supported by the gear cover, and thus an inclination of the support shaft to the gear case is prevented and the mesh accuracy of the drive gear and the driven gear can be further increased.

According to the present invention, a bolt for fixing the gear cover to the gear case is used also as a bolt for fixing the gear case to the vehicle, and thus the number of parts of the automatic opening and closing apparatus is reduced and a cost of the parts can be reduced.

According to the present invention, the support shaft is provided to the bracket integrally fixed to the gear case and the gear cover is fixed to the bracket by the first fastening member, and thus it is compatible to specifications of the vehicle by changing the bracket and/or the drive arm etc. In this manner, the gear case is used together for each specification, and versatility of the automatic opening and closing apparatus can be increased.

According to the present invention, the bracket is fixed to the gear case as the gear cover and the driven gear are being assembled and unitized, thereby making assembly work of the automatic opening and closing apparatus easier.

According to the present invention, the gear cover suppressing an inclination of the driven gear is supported by both sides of the gear case interposing the mesh portion of the drive gear and the driven gear, and the output shaft and the support shaft are supported by the gear cover, and thus an inclination of the driven gear is surely prevented by the gear cover and the supporting rigidity of the support shaft supporting the driven gear and the output shaft, to which the drive gear is provided, is increased, and the mesh accuracy of the drive gear and the driven gear can be increased.

BEST MODE FOR CARRYING OUT THE INVENTION

Hereinafter, embodiments of the present invention will be described in detail with reference to the accompanying drawings.

Figure 1:
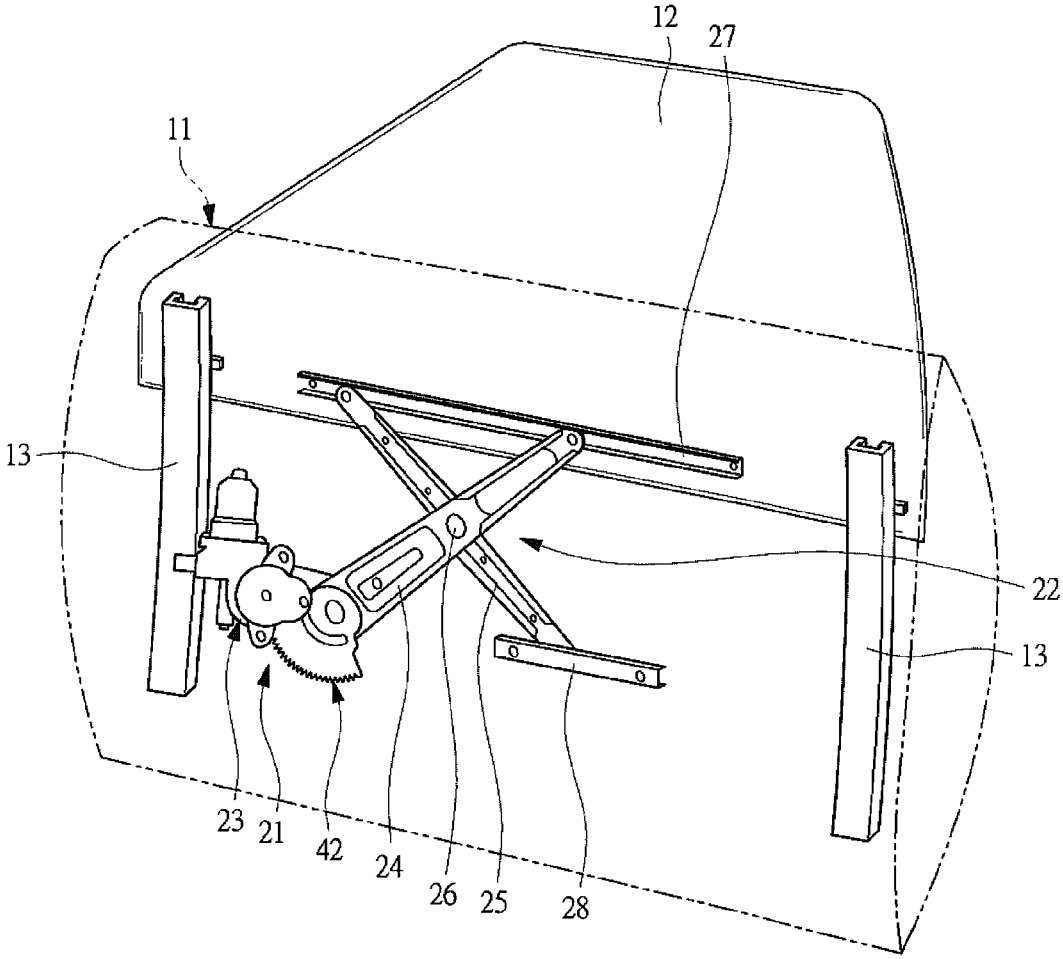
FIG. 1 is a perspective view of a door including a power window apparatus which is an embodiment of the present invention.

FIG. 1 is a perspective view of a door including a power window apparatus which is an embodiment of the present invention, and this door 11 is a front door composing a vehicle body of a vehicle not illustrated, and a window glass 12 as an opening and closing body is provided to the door 11. The window glass 12 is supported by a pair of guide units 13 provided inside the door 11 and is openable and closable in a vertical direction of the vehicle along these guide units 13. A power window apparatus 21 as an automatic opening and closing apparatus is disposed inside the door 11, and the window glass 12 is automatically opened and closed by the power window apparatus 21.

The power window apparatus 21 includes a window regulator 22 and a drive unit 23, and the structure is such that the window regulator 22 is activated by the drive unit 23 so that the window glass 12 is opened and closed.

The window regulator 22 is an X-arm type and includes a lift arm 24 as a drive arm and an equalizer arm 25. The lift arm 24 is formed of a steel plate and supported by the drive unit 23 at a base end portion of the lift arm 24 and is swingable in the vertical direction inside the door 11. Meanwhile, the equalizer arm 25 is formed of a steel plate and pivotally supported to a substantially center portion in a longitudinal direction of the lift arm 24 by a coupling shaft 26 at a substantially center portion in a longitudinal direction of the equalizer arm 25. A roller not illustrated is attached to a tip portion of the lift arm 24 and a tip portion of the equalizer arm 25, respectively, and these rollers are movably attached to a roller guide 27 fixed to a bottom end of the window glass 12. Also, a roller not illustrated is also attached to the base end portion of the equalizer arm 25 and the roller is movably attached to a roller guide 28 fixed to the door 11. The drive unit 23 drives the lift arm 24 to swing the same, and, when the lift arm 24 is driven to swing by the drive unit 23, the lift arm 24 and the equalizer arm 25 are operated to swing about the coupling shaft 26 and the window glass 12 is opened and closed in a vertical direction in FIG. 1.

Figure 2:
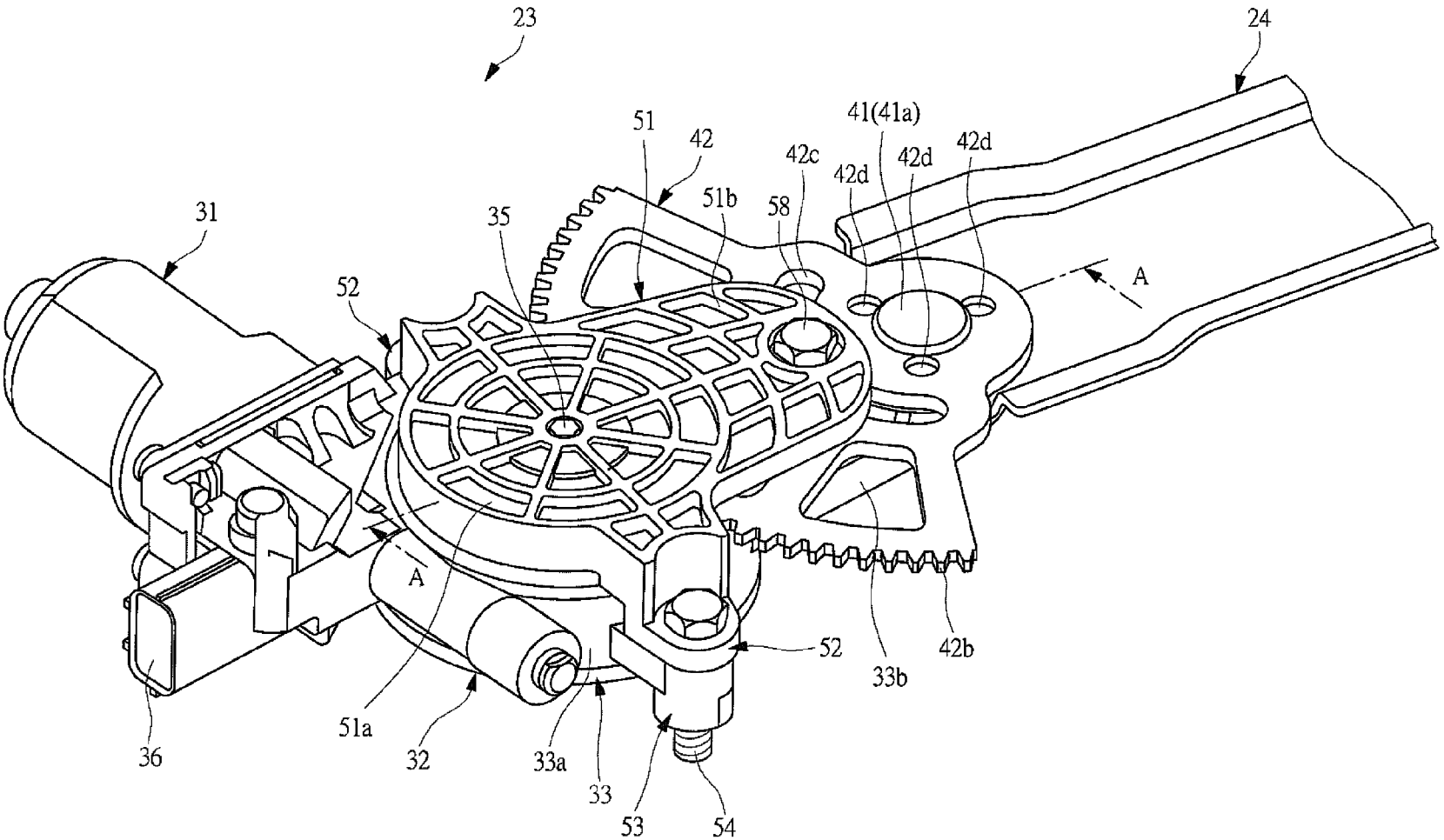
FIG. 2 is a perspective view illustrating details of a drive unit illustrated in FIG. 1.
Figure 3:
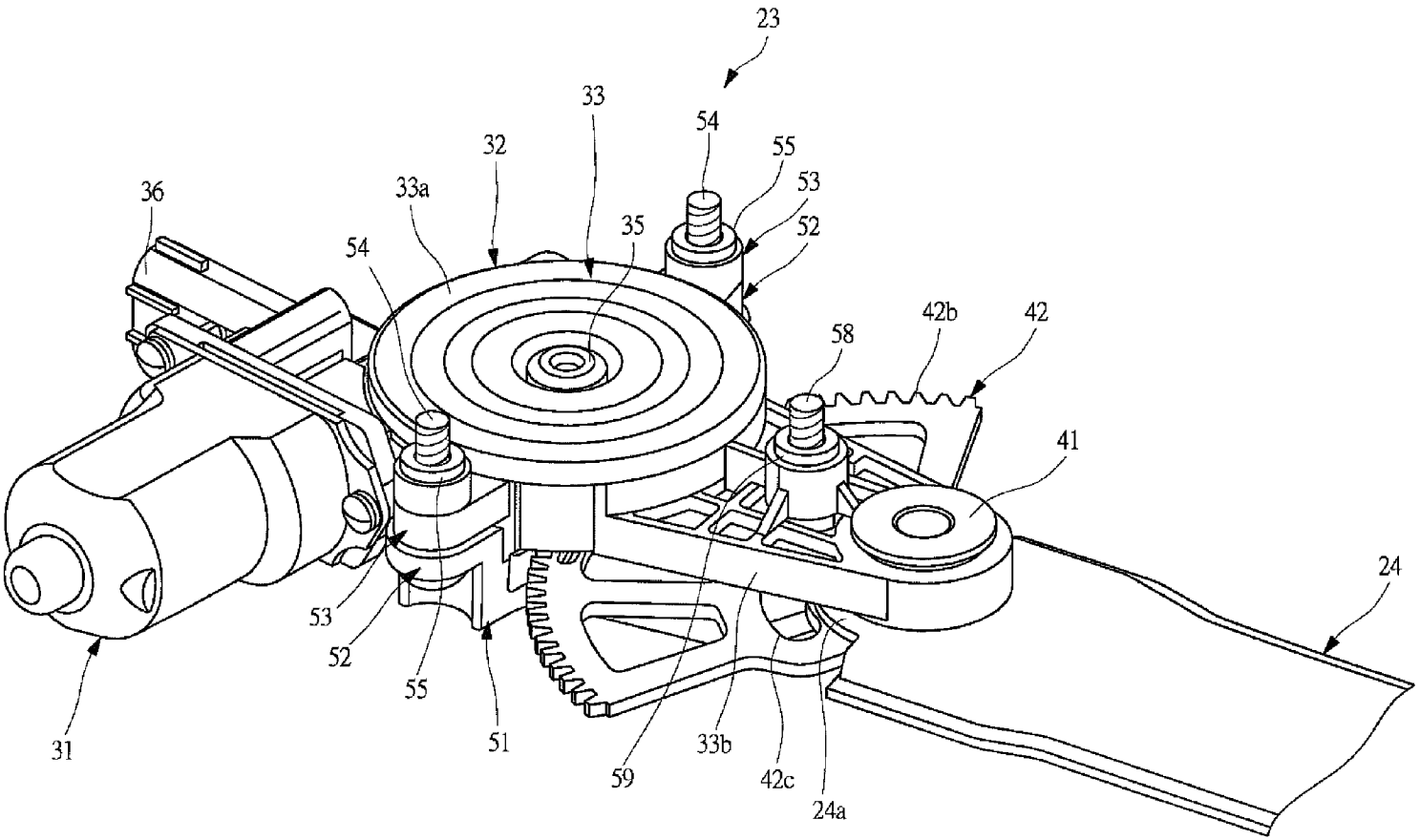
FIG. 3 is a perspective view of the drive unit illustrated in FIG. 2 viewed from back.
Figure 4:
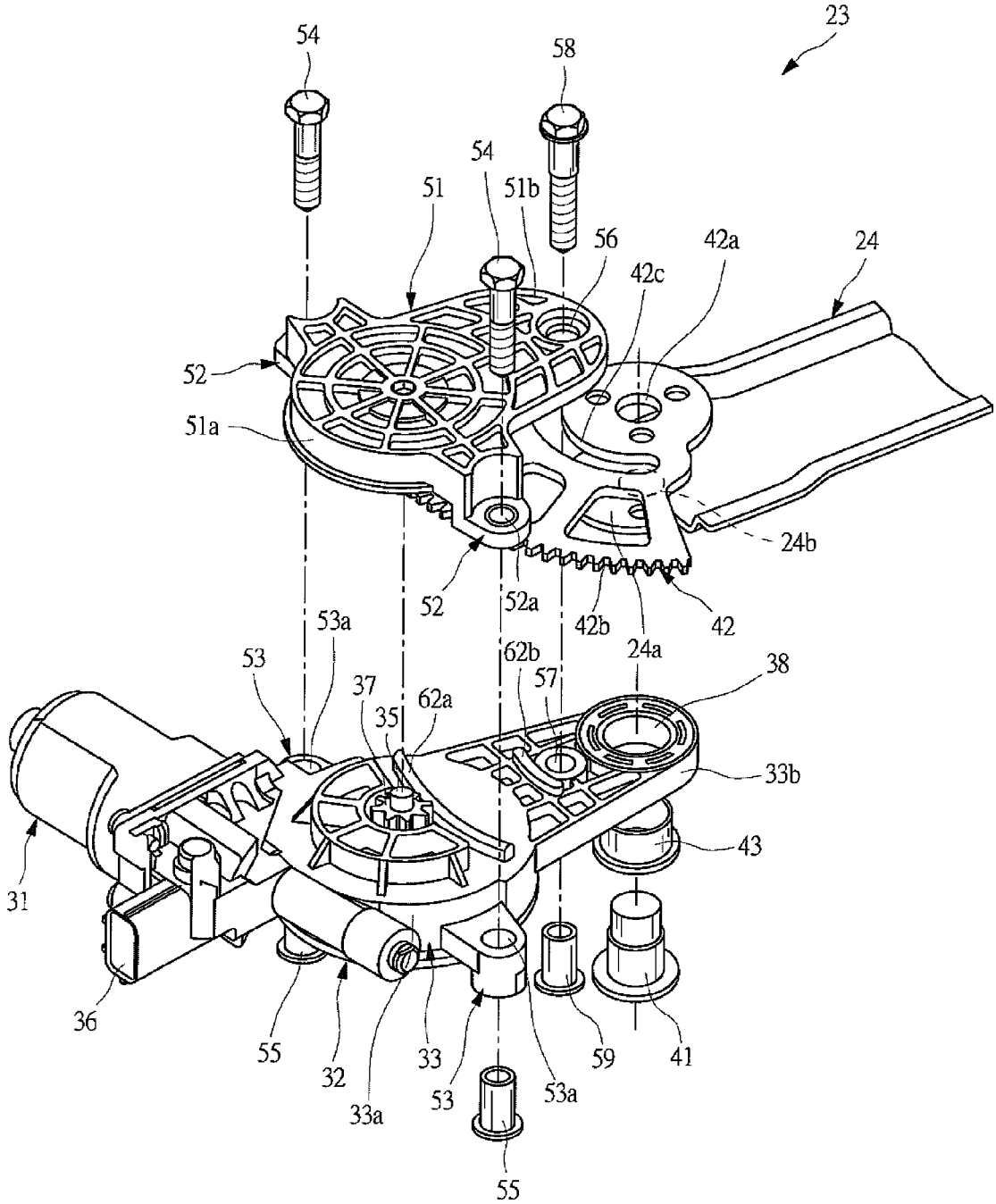
FIG. 4 is an exploded perspective view of the drive unit illustrated in FIG. 2.

FIG. 2 is a perspective view illustrating details of the drive unit illustrated in FIG. 1, and FIG. 3 is a perspective view of the drive unit illustrated in FIG. 2 viewed from back. In addition, FIG. 4 is an exploded perspective view of the drive unit illustrated in FIG. 2, and FIG. 5 is a cross-sectional view taken along the line A-A in FIG. 2.

Next, structure of the drive unit 23 will be described.

The drive unit 23 includes an electric motor 31, and a speed reducer 32 is installed to the electric motor 31 as one unit. The speed reducer 32 includes a gear case 33 made of a resin installed to the electric motor 31, and a worm gear mechanism 34 is embedded inside a main body portion 33*a* formed in a column shape of the gear case 33.

Figure 5:
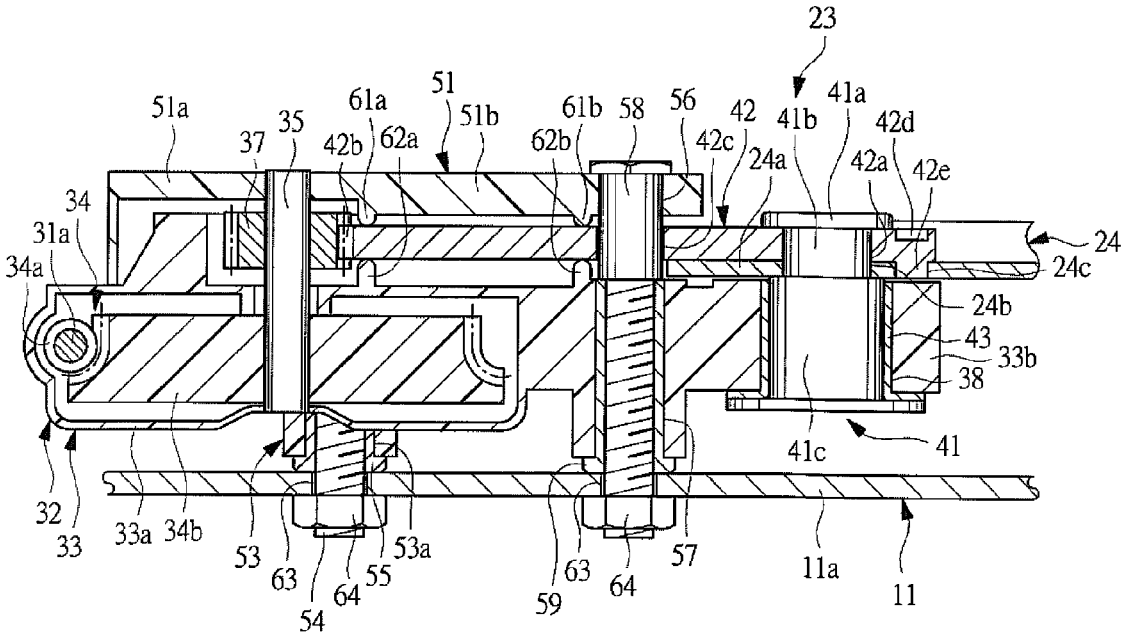
FIG. 5 is a cross-sectional view taken along the line A-A in FIG. 2.

As illustrated in FIG. 5, the electric motor 31 includes an armature shaft 31*a* as a rotation shaft, and the armature shaft 31*a* protrudes inside the main body portion 33*a* of the gear case 33, and a worm 34*a* is integrally formed to an outer periphery surface of the protruding portion. A worm wheel 34*b* meshing with the worm 34*a* is contained in the main body portion 33*a* of the gear case 33, and the worm gear 34*b* is fixed to an output shaft 35 supported to the gear case 33 and is rotatable together with the output shaft 35. The worm gear mechanism 34 is formed of a worm 34*a* and a worm wheel 34*b*, and, when the electric motor 31 is activated, speed of rotation of the armature shaft 31*a* is reduced to a predetermined number of rotations and the speed of rotation is outputted from the output shaft 35.

A connector 36 is integrally provided to the gear case 33 and the electric motor 31 is connected to a control apparatus not illustrated to be mounted on the vehicle via the connector 36. And, activation of the electric motor 31 is controlled by the control apparatus based on instruction signals of a power window switch etc.

A tip of the output shaft 35 protrudes outside the gear case 33 and a pinion 37 as a drive gear is fixed to the tip of the output shaft protruding outside the gear case 33 as illustrated in FIGS. 4 and 5. That is, the pinion 37 is disposed outside the gear case 33, i.e., on an outer surface of the main body portion 33*a* and is rotated together with the output shaft 35.

To the gear case 33, a base portion 33*b*, which protrudes from the main body portion 33*a* in a diametrical direction of the main body portion 33*a*, is integrally provided, and a supporting hole 38 is formed to a tip side of the base portion 33*b*. A shaft bearing 43 is inserted into the supporting hole 38 to pivotally support a large-diameter portion 41*c* of a support shaft 41, and a sector gear 42 as a driven gear is swingably supported to the base portion 33*b* by the support shaft 41 integrally supported to the base portion 33*b*.

The sector gear 42 is formed of a steel plate in a fan-like shape and an attaching hole 42*a* is provided to a shaft center of the sector gear 42. Also, a gear portion 42*b* is provided to an outer periphery portion in a circular arc shape of the sector gear 42, and a groove portion 42*c* in a circular arc shape about the shaft center, i.e., the attaching hole 42*a* is formed between the gear portion 42*b* and the attaching hole 42*a*. The sector gear 42 is swingably supported by the support shaft 41 as the support shaft 41 is inserted into the attaching hole 42*a*, and the gear portion 42*b* is meshed with the pinion 37. In this manner, the sector gear 42 is driven by the pinion 37, i.e., the electric motor 31 when the electric motor 31 is activated, and is swung in a predetermined angle range about the support shaft 41 as a center.

Herein, in the power window apparatus 21, as described above, the pinion 37 is supported to the gear case 33 by the output shaft 35, and the sector gear 42 to be meshed with the pinion 37 is supported to the base portion 33*b* of the gear case 33 by the support shaft 41. In this manner, a mesh pitch of the pinion 37 and the sector gear 42 can be maintained at good accuracy by the gear case 33, and thus the mesh accuracy of the pinion 37 and the sector gear 42 is ensured and activation efficiency of the drive unit 23 can be increased.

Meanwhile, a locking piece 24*a* is integrally formed to the base end of the lift arm 24. The locking piece 24*a* is disposed to overlap with the sector gear 42 between the sector gear 42 and the base portion 33*b*, and the support shaft 41 is inserted into a through-hole 24*b* of the locking piece 24*a*. Around the through-hole 24*b* of the locking piece 24*a*, three fixing holes 24*c* are concentrically formed next to each other at constant spacing. Meanwhile, around the attaching hole 42*a* of the sector gear 42, three fixing bosses 42*e* are concentrically formed next to each other on the lift arm 24 side by forming concave portions 42*d* on the gear cover 51 side by repousse or the like, and the fixing holes 24*c* and the fixing bosses 42*e* are engagable with each other. That is, the lift arm 24 and the sector gear 42 are separately formed and the lift arm 24 is integrally engaged with the sector gear 42 at the base end of the lift arm 24 and is swingably supported to the support shaft 41 together with the sector gear 42.

Note that, as illustrated in FIGS. 4 and 5, the support shaft 41 is inserted into the supporting hole 38 from an opposite side of the sector gear 42 interposing the base portion 33*b* so that a large-diameter portion 41*c* is pivotally supported, and a small-diameter portion 41*b* of the support shaft 41 penetrates the attaching hole 42*a* of the sector gear 42 and the through-hole 24*b* of the locking piece 24*a* so that the tip portion 41*a* is swaged on the sector gear 42 side as the fixing holes 24*c* and the fixing bosses 42*e* are being engaged with each other. In this manner, concave and convex engagement of the lift arm 24 and the sector gear 42 is maintained. Note that the lift arm 24 and the sector gear 42 may be fixed to a pivot portion of the sector gear 42 by a fastening means such as welding, screwing, riveting, etc.

To the gear case 33, to cover the mesh portion of the pinion 37 and the sector gear 42 and to suppress an inclination of the sector gear 42 to the shaft direction of the support shaft 41, a gear cover 51 is fixed.

Figure 6:
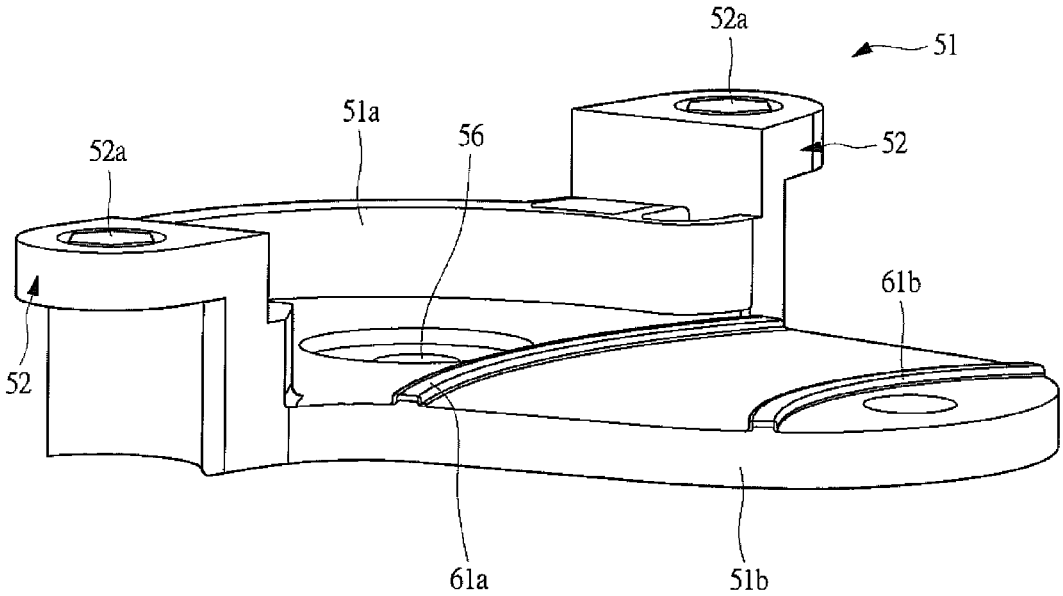
FIG. 6 is a perspective view illustrating details of a gear cover illustrated in FIG. 2.

FIG. 6 is a perspective view illustrating details of the gear cover illustrated in FIG. 2, in which the gear cover 51 is made of a resin, and a cylindrical portion 51*a* covering one of outer surfaces of the gear cover 51 to which the pinion 37 of the main body portion 33*a* of the gear case 33 is disposed is integrally formed with an extension portion 51*b* in a plate shape extending in a diametrical direction from the cylindrical portion 51*a* to the support shaft 41.

To the cylindrical portion 51*a* of the gear cover 51, a pair of cover side fixing legs 52 are integrally formed protruding in opposite sides to each other in a perpendicular direction with respect to the extending direction of the extension portion 51*b*, respectively, and a bolt hole 52*a* is provided to each of the cover side fixing legs 52. Meanwhile, a pair of case side fixing legs 53 corresponding to the cover side fixing legs 52 are provided to the main body portion 33*a* of the gear case 33, and an inserting hole 53*a* is provided to each of the case side fixing legs 53.

A bolt 54 as the second fastening member is inserted into the bolt hole 52*a* of each of the cover side fixing legs 52 from an opposite side of the gear case 33, and a nut 55 in a sleeve shape having a flange is inserted into the inserting hole 53*a* of each of the case side fixing legs 53 from an opposite side of the gear cover 51; and each of the bolts 54 is screw-coupled to a corresponding one of the nuts 55 so that the gear cover 51 is fixed to the gear case 33.

Herein, the cover side fixing legs 52 and the case side fixing legs 53 are arranged on an outer periphery side of the sector gear 42, i.e., outside a moving range of the sector gear 42. In this manner, the gear cover 51 is fixed to the gear case 33 by the bolts 54 and nuts 55 on the outer periphery side of the sector gear 42.

As illustrated in FIG. 4, a bolt 56 which is opened toward the groove portion 42*c* of the sector gear 42 is provided to a tip side of the extension portion 51*b* of the gear cover 51, and an inserting hole 57 which is opened toward the groove portion 42*c* is provided to the base portion 33*b* of the gear case 33 corresponding to the bolt hole 56. Into the bolt hole 56, a bolt 58 as the first fastening member is inserted from an opposite side of the base portion 33*b*, and the bolt 58 protrudes to a back surface side of the base portion 33 by penetrating the groove portion 42*c* of the sector gear 42 and the inserting hole 57 of the gear case 33. Meanwhile, into the inserting hole 57 of the base portion 33*b*, a nut 59 in a sleeve shape having a flange is inserted from an opposite side of the extension portion 51*b*, and the bolt 58 is screw-coupled to the nut 59. In this manner, the extension portion 51*b* of the gear cover 51 is fixed to the base portion 33*b* of the gear case 33 by the bolt 58 penetrating the groove portion 42*c* of the sector gear 42, the gear cover 51 being fixed closer to the side of the support shaft 41 than the mesh portion of the pinion 37 and the sector gear 42 with respect to the bolt 54 on the cylindrical portion 51*a* side. More specifically, the gear cover 51 is fixed (supported) at its both sides to the gear case 33 interposing the mesh portion of the pinion 37 and the sector gear 42.

As illustrated in FIGS. 5 and 6, a pair of cover side pressing portions 61*a* and 62*b* are provided to an inner surface of the gear cover 51 opposing the sector gear 42. The cover side pressing portions 61*a* and 61*b* extend like a circular arc, respectively, about the support shaft 41 when the gear cover 51 is fixed to the gear case 33, and the cover side pressing portions 61*a* and 61*b* are formed in a rib shape protruding toward the sector gear 42 from the inner surface of the gear cover 51. In addition, one of the cover side pressing portions 61*a* abuts a side surface of the sector gear 42 at a base portion of the gear portion 52*b* of the sector gear 42, and the other cover side pressing portions 61*b* abuts a side surface of the sector gear 42 in an outer periphery portion of the attaching hole 42*a* of the sector gear 42.

Meanwhile, as illustrated in FIGS. 4 and 5, a pair of case side pressing portions 62*a* and 62*b* are provided to an outer surface of the gear case 33 opposing the sector gear 42. The case side pressing portions 62*a* and 62*b* also extend like a circular arc about the support shaft 41 and are formed in a rib shape protruding toward the sector gear 42 from the outer surface of the gear case 33; and one of the case side pressing portions 62*a* abuts a side surface of the sector gear 42 at a base portion of the gear portion 42*b* of the sector gear 42 from an opposite side of the cover side pressing portion 61*a*, and the other of the case side pressing portions 62*b* abuts a side surface of the sector gear 42 at an outer periphery portion of the attaching hole 42*a* of the sector gear from an opposite side of the cover side pressing portion 61*b*. More specifically, the sector gear 42 has the base portion of the gear portion 42*b* being sandwiched between the cover side pressing portion 61*a* provided to the gear cover 51 and the case side pressing portion 61*b* provided to the gear case 33, and also has the outer periphery portion of the attaching hole 42*a* being sandwiched between the cover side pressing portion 61*b* provided to the gar cover 51 and the case side pressing portion 62*b* provided to the gear case 33, so that the sector gear 42 is pressed to the gear case 33 by the gear cover 51 and thus an inclination of the sector gear 42 taking the support shaft 41 as a point of support is suppressed.

In this manner, in the power window apparatus 21, the gear cover 51 covering the mesh portion of the pinion 37 and the sector gear 41 presses the sector gear 42 to the gear case 33 so that an inclination of the sector gear 42 taking the support shaft 41 as a point of support is suppressed, and thus mesh accuracy of the pinion 37 and the sector gear 42 is ensured and generation of abnormal noise from the mesh portion is prevented, and also activation efficiency of the drive unit 23 can be increased. In addition, the case side pressing portions 62*a* and 62*b* in a circular arc shape provided to the gear case 33 and the cover side pressing portions 61*a* and 61*b* in a circular arc shape provided to the gear cover 51 press the sector gear 42, and thus each of the pressing portions 61*a*, 61*b*, 62*a*, and 62*b* is always abutted in a predetermined range to the sector gear 42 swung in a predetermined range, thereby surely suppressing an inclination of the sector gear 42.

Also, as described above, in the power window apparatus 21, the gear cover 51 suppressing an inclination of the sector gear 42 is fixed by the bolt 58 penetrating the groove portion 42*c* provided to the sector gear 42 and the bolt 54 disposed in the outer periphery of the sector gear 42, and thus the gear cover 51 can be supported by its both sides to the gear case 33 interposing the mesh portion of the pinion 37 and the sector gear 42. In this manner, load from the sector gear 42 is surely supported by the gear cover 51 and thus an inclination of the sector gear 42 about the support shaft 41 can be surely prevented.

Further, in the power window apparatus 21, the lift arm 24 and the sector gear 42 are separately formed, and thus the lift arm 24 having a different shape corresponding to specifications of the vehicle can be used while the drive unit 23 is unchanged. In this manner, the drive unit 23 is used together for each specification, and thus versatility of the drive unit 23, that is, the power window apparatus 21 can be increased.

As illustrated in FIG. 5, the bolts 54 and 58, which fix the gear cover 51 to the gear case 33, as being screw-coupled to the nuts 55 and 59, have the tip portions penetrating the nuts 55 and 59, respectively, and protrude to the back surface side of the gear case 33. Meanwhile, to a door panel 11*a* provided inside the door 11, assembling holes 63 for assembling the drive unit 23 are provided. And, as the tip portions of the bolts 54 and 58 are inserted into corresponding assembling holes 63 and the nuts 64 are fastened to the bolts 54 and 58 from an opposite side of the door panel 11*a*, the drive unit 23 is fixed to the door panel 11*a* having the shaft direction of the pinion 37 in the thickness direction of the door 11.

In this manner, in the power window apparatus 21, the tip portions of the bolts 54 and 58 for fixing the gear cover 51 to the gear case 33 are used as fixing portions to the vehicle, and also used as bolts for fixing the gear case 33, i.e., the drive unit 23 to the door panel 11*a*, and thus another bolt for fixing the drive unit 23 to the door panel 11*a* is unnecessary. In this manner, the number of parts of the power window apparatus 21 is reduced and thus the cost can be reduced.

Figure 7:
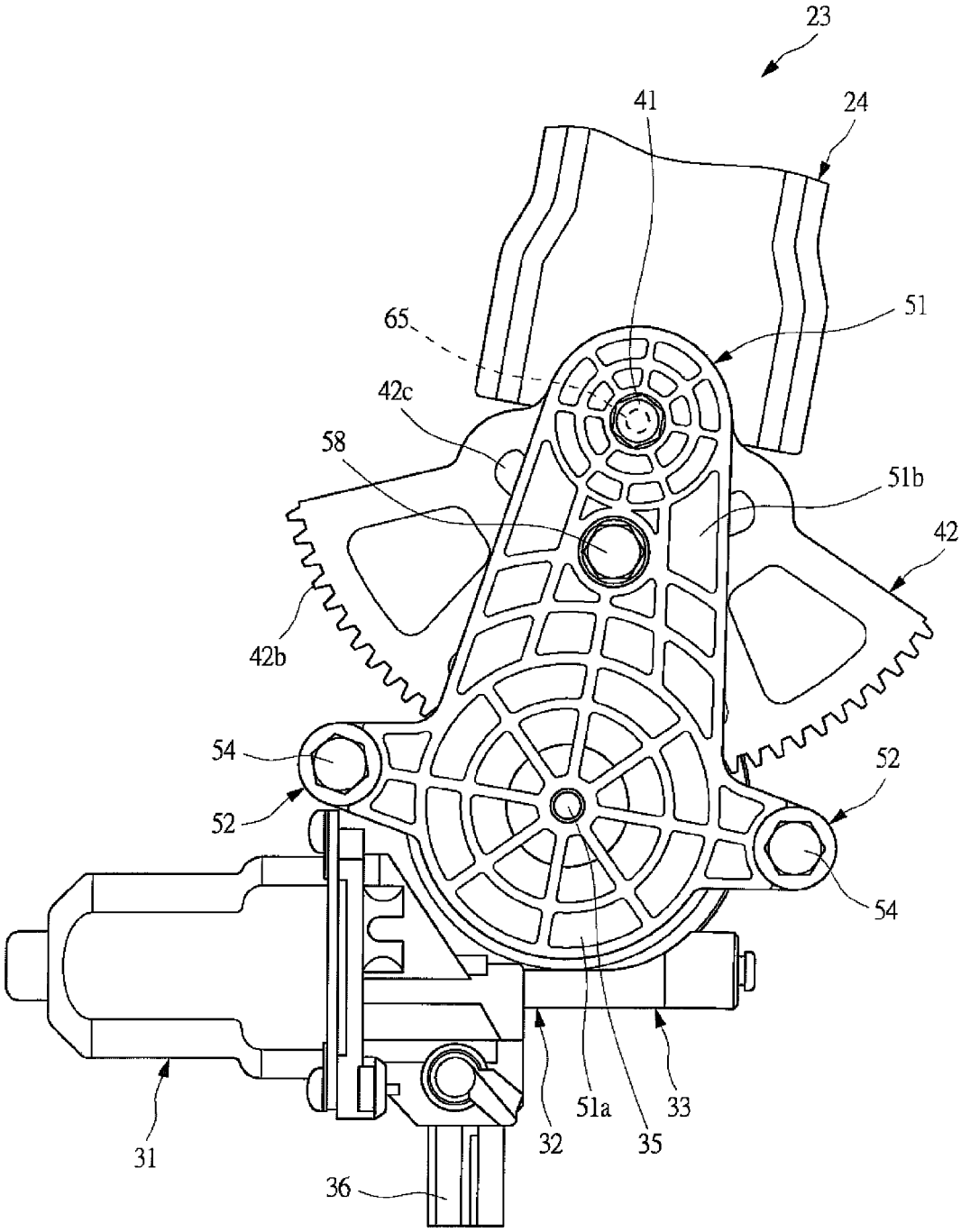
FIG. 7 is a front view illustrating a modification example of the drive unit illustrated in FIG. 2.

FIG. 7 is a front view illustrating a modification example of the drive unit illustrated in FIG. 2. Note that, in FIG. 7, members corresponding to those described above are denoted by the same reference numerals.

In the case illustrated in FIG. 2, the support shaft 41 which swingably supports the sector gear 42 and the lift arm 24 is supported at only one end in its shaft direction by the supporting hole 38 provided to the base portion 33*b* of the gear case 33.

In contrast, in the modification example illustrated in FIG. 7, the extension portion 51*b* of the gear cover 51 fixed to the gear case 33 is further extended to a portion of the support shaft 41, and the other end of the support shaft 41 is supported by a supporting hole 65 provided to the extension portion 51*b*. In this manner, the support shaft 41 is supported at its both ends by the gear case 33 and the gear cover 51 interposing the sector gear 42 and thus the supporting rigidity is increased.

In this manner, one end (base end) of the support shaft 41 is supported by the supporting hole 38 of the gear case 33, and also, the other end (tip) of the support shaft 41 is supported by the supporting hole 65 of the gear cover 51, thereby increasing the supporting rigidity of the support shaft 41, and thus an inclination of the sector gear 42 supported by the support shaft 41 can be more surely prevented.

Figure 8A:
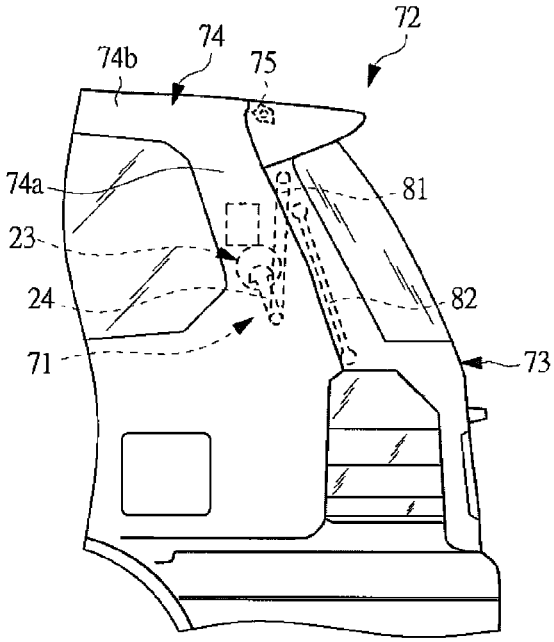
FIGS. 8A and 8B are diagrams illustrating a part of a vehicle including a power tailgate apparatus which is another embodiment of the present invention, respectively.
Figure 8B:
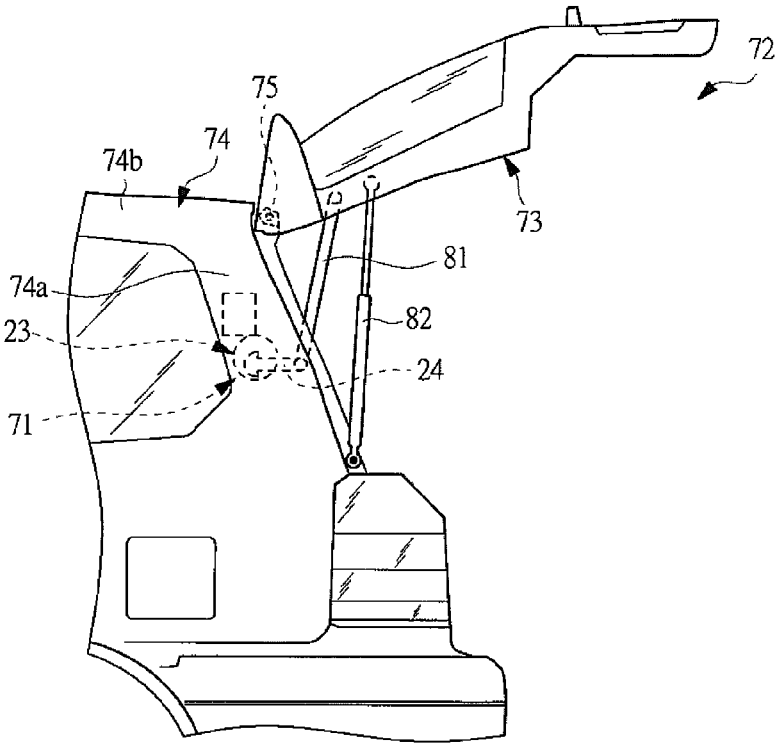
Figure 9:
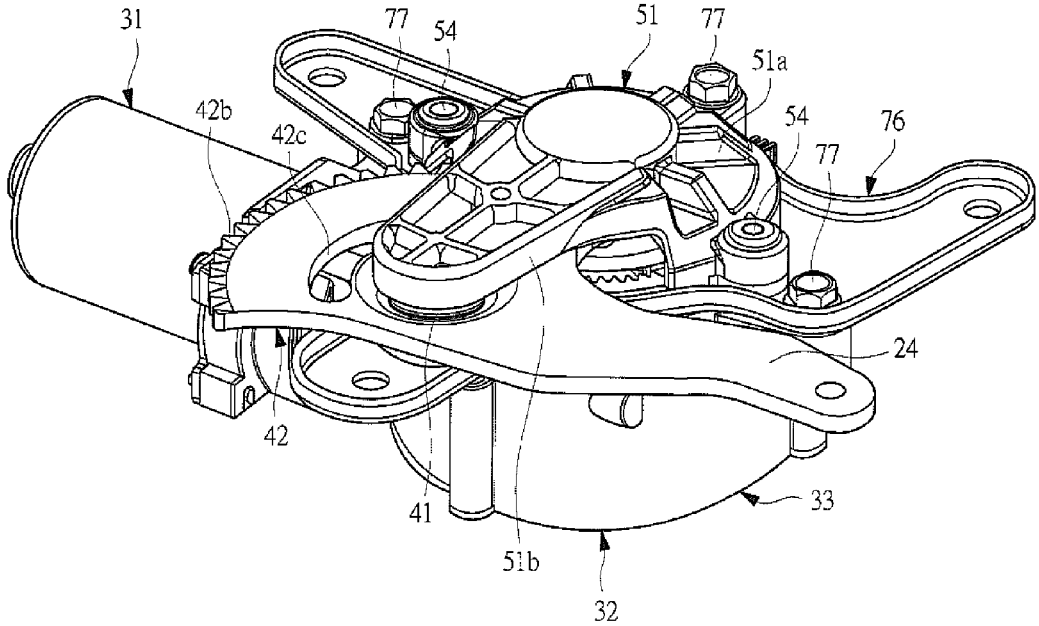
FIG. 9 is a perspective view illustrating details of the power tailgate apparatus illustrated in FIGS. 8A and 8B.
Figure 10:
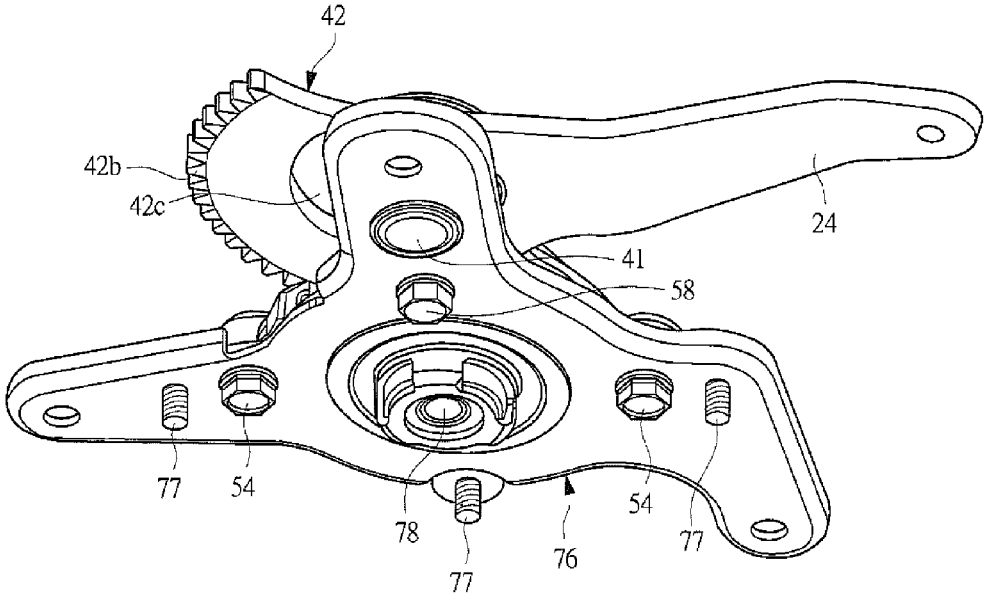
FIG. 10 is a perspective view illustrating a bracket illustrated in FIG. 9 in a unitized state.

FIGS. 8A and 8B are diagrams illustrating a part of the vehicle mounting a power tailgate apparatus which is another embodiment, respectively, FIG. 9 is a perspective view illustrating details of the power tailgate apparatus illustrated in FIGS. 8A and 8B, and FIG. 10 is a perspective view illustrating a unitized state of a bracket illustrated in FIG. 9. Note that, in FIGS. 8A to 10, members corresponding to those described above are denoted by the same reference numerals.

A power tailgate apparatus 71 as an automatic opening and closing apparatus described in the present embodiment automatically opens and closes a tailgate 73 as an opening and closing body provided to a vehicle 72, and the drive unit 23 of the power tailgate apparatus 71 is disposed to a rear pillar 74*a* of a vehicle body 74.

The tail gate 73 is attached to a rear end portion of a roof portion 74*b* of the vehicle body 74 via a hinge 75, and the tailgate 73 is openable and closable in the vertical direction of the vehicle 72 between a full-close position illustrated in FIG. 8A and a full-open position illustrated in FIG. 8B around the hinge 75 as a center.

As illustrated in FIG. 9, the drive unit 23 includes a bracket 76 formed of a steel plate, and the bracket 76 is integrally fixed by three bolts 77 to an outer surface of the gear case 33 to which the output shaft 35 is provided. A pinion (not illustrated) is rotatably supported to the bracket by a shaft bearing 78 and integrally and rotatably coupled to an output shaft (not illustrated) inside the speed reducer 32 to rotate together with the output shaft when the bracket 76 is integrally fixed to the gear case 33.

Also, the support shaft 41 is provided between the bracket 76 and the extension portion 51*b* of the gear cover 51, and the sector gear 42 is swingably supported by the bracket 76 via the support shaft 41. That is, the sector gear 42 is swingably supported to the gear case 33 by the support shaft 41 provided to the bracket 76. Also, the gear cover 51 is also fixed to the bracket 76 by the bolts 54 and 58. In this manner, also in the present embodiment, the support shaft 41 is supported at its both ends by the bracket 76 and the gear cover 51 interposing the sector gear 42, thereby increasing the supporting rigidity.

As illustrated in FIG. 10, the bracket 76 is unitized as the pinion, the support shaft 41, the sector gear 42, the gear cover 51, etc. have been previously assembled. And, the bracket 76 is fixed to the gear case 33 by the bolts 77 in the unitized state.

In this manner, the bracket 76 is fixed to the gear case 33 as the bracket 76 has been previously unitized as the sector gear 42 and the gear cover 51, etc. have been assembled, and thus assembling work of the power tailgate apparatus 71 can be made easier.

Also, in the power tailgate apparatus 71, the bracket 76, which is unitized with having the sector gear 42 and the gear cover 51 etc. are assembled, is fixed to the gear case 33, and thus it is possible to accommodate to specification changes of the vehicle 72 side by changing the bracket 76 while the gear case 33 is also used together. In this manner, the versatility of the gear case 33, i.e., the power tailgate apparatus 71 can be increased.

In the present embodiment, the lift arm 24 is integrally formed with the sector gear 42, and a tip of the lift arm 24 is coupled to the tailgate 73 via a drive rod 81. And, the lift arm 24 is swung in the vertical direction of the vehicle 72 together with the sector gear 42, so that the tailgate 73 is opened and closed.

Note that the reference numeral 82 denotes a gas stay for subserving opening and closing of the tailgate 73.

Figure 11:
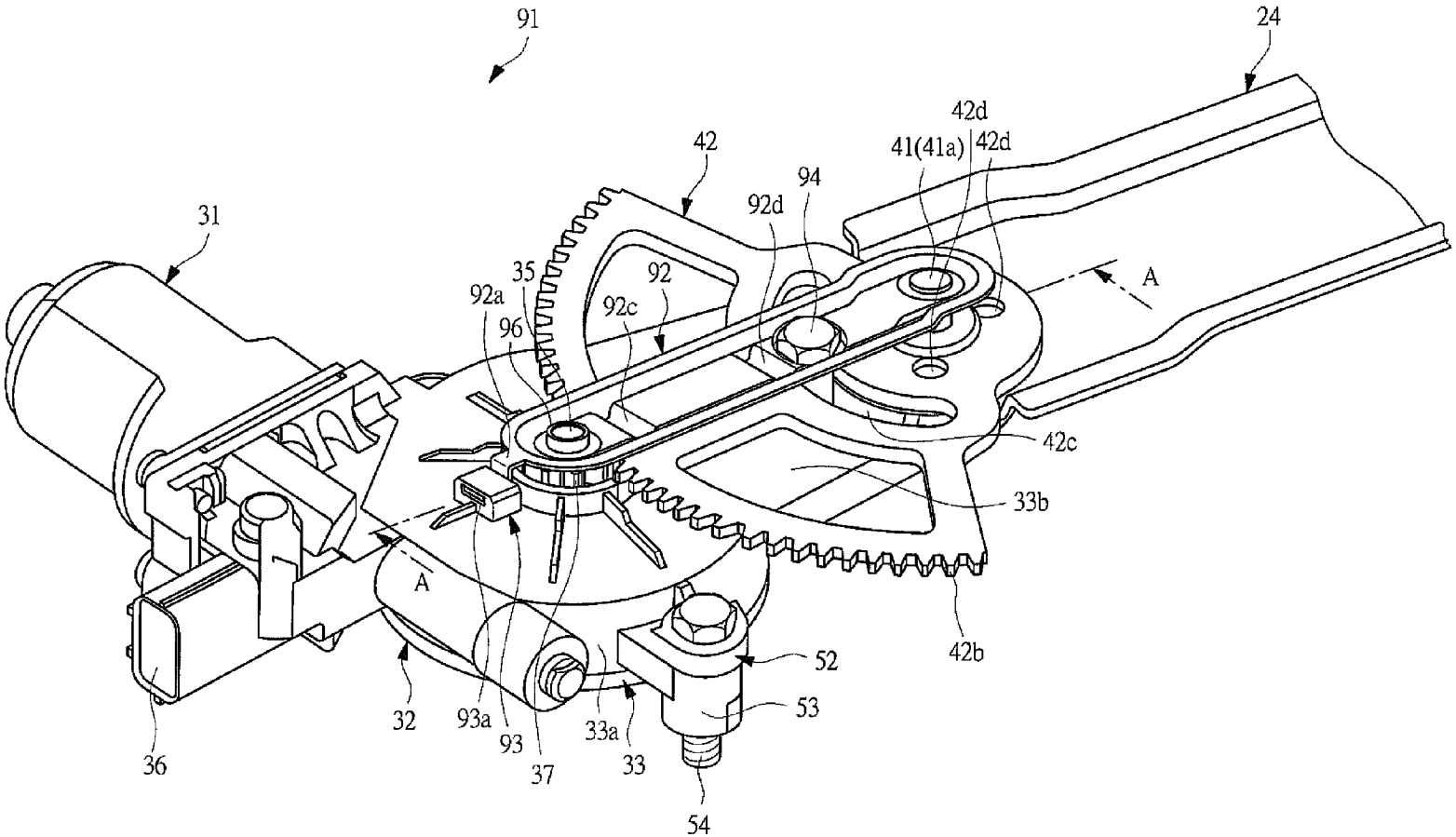
FIG. 11 is a perspective view illustrating a modification example of the drive unit illustrated in FIG. 2.
Figure 12:
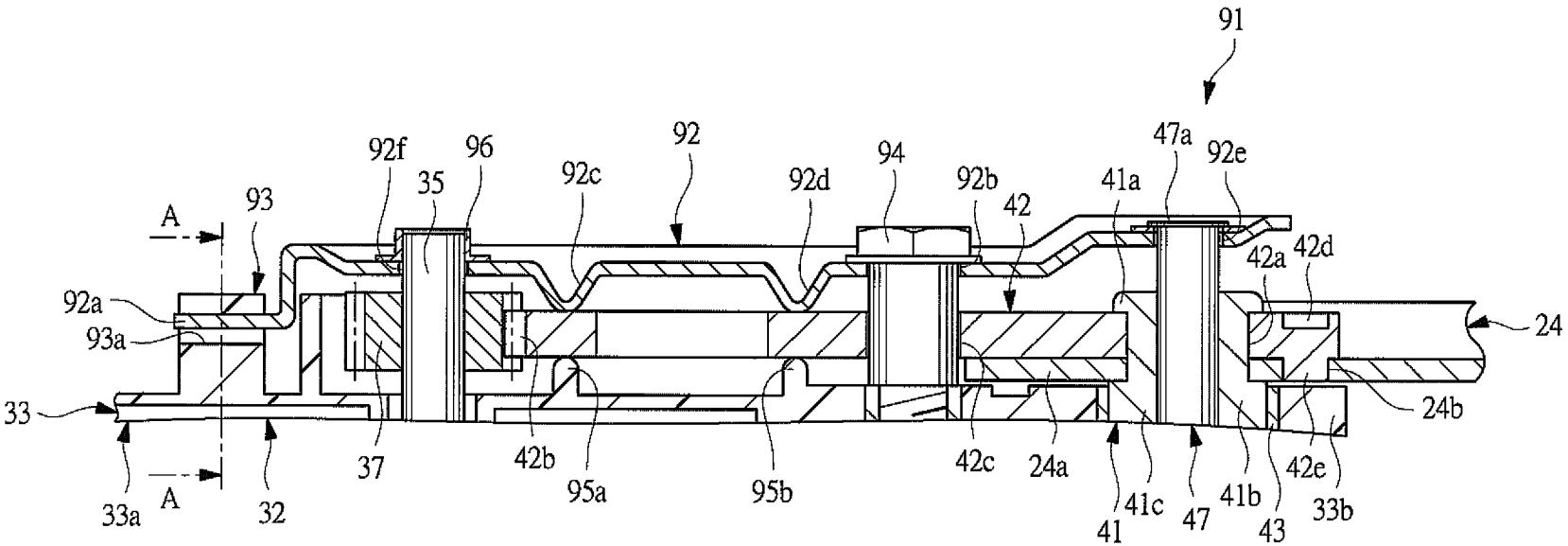
FIG. 12 is a cross-sectional view taken along the line A-A in FIG. 11.
Figure 13:
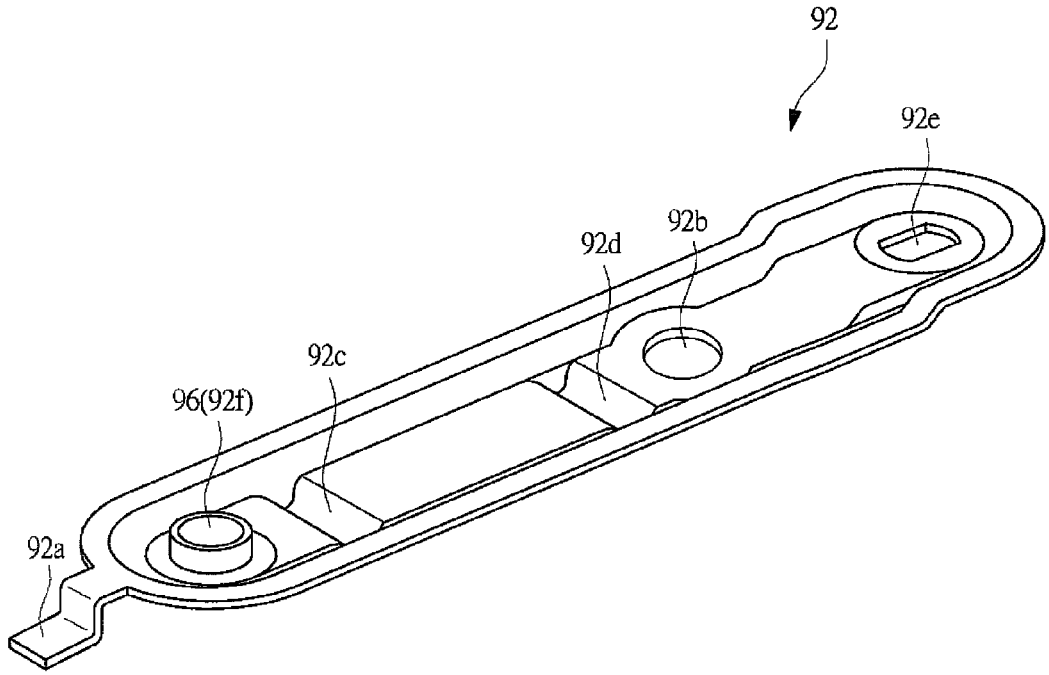
FIG. 13 is a perspective view illustrating details of a gear cover illustrated in FIG. 11.
Figure 14:
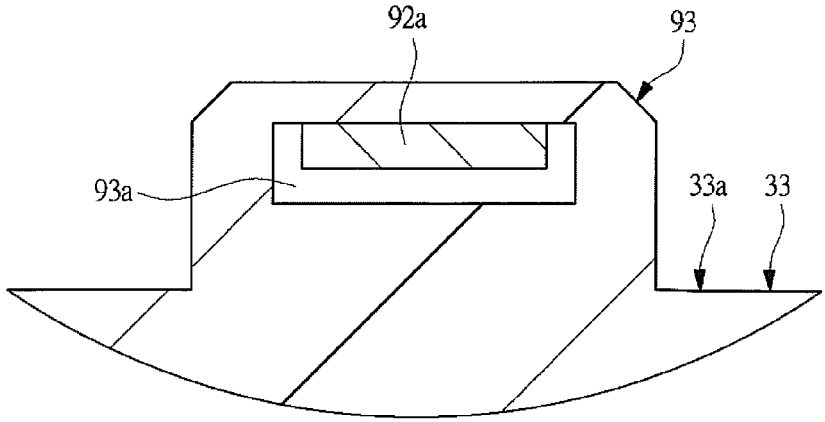
FIG. 14 is a cross-sectional view taken along the line A-A in FIG. 12.

FIG. 11 is a perspective view illustrating a modification example of the drive unit illustrated in FIG. 2, FIG. 12 is a cross-sectional view taken along the line A-A in FIG. 11, FIG. 13 is a perspective view illustrating details of a gear cover illustrated in FIG. 11, and FIG. 14 is a cross-sectional view taken along the line A-A in FIG. 12.

In the drive unit 23 illustrated in FIG. 2, the gear cover 51 formed of a resin in which the cylindrical portion 51*a* and the extension portion 51*b* are integrally formed is used as a gear cover. In contrast, in a drive unit 91 illustrated in FIG. 11, a gear cover 92 formed of a sheet metal formed by pressing a plate material such as a steel plate is used as a gear cover. Also, the sector gear 42 is swingably assembled to the gear case 33 by the support shaft 41 penetrating the gear case 33. Note that the support shaft 41 is formed to have its center having a spouted shape, and a shaft 47 having one end assembled to the vehicle body and the other end assembled to the gear cover 92 is inserted into the spouted portion.

As illustrated in FIG. 12, the gear cover 92 is formed in a long plate shape, and a locking piece 92*a* bended like a crank is integrally provided to one end in a longitudinal direction of the gear cover 92, and a bolt hole 92*b* is provided at a middle portion in the longitudinal direction.

Meanwhile, a locking block 93 is provided to the main body portion 33*a* of the gear case 33 of the drive unit 91 corresponding to the locking piece 92*a* of the gear cover 92. The locking block 93 is integrally formed with the main body 33*a*, and disposed on the outer surface of the main body portion 33*a* to be adjacent to the pinion 37 in a direction to be away from the output shaft 35 on an extended line connecting the output shaft 35 and the support shaft 41. That is, the locking block 93 is disposed on an outer periphery side of the sector gear 42 on the main body 33*a* of the gear case 33. A fixing hole 93*a* extended along a diametrical direction of the output shaft 35 is provided to the locking block 93 as illustrated in FIG. 14. And, the gear cover 92 is fixed to the locking block 93, i.e., the gear case 33 at one end of the gear cover 92 as a tip portion of the locking piece 92*a* is inserted into the fixing hole 93*a*. In this manner, in the drive unit 91, the structure of fixing the gear cover 92 to the gear case 33 on the outer periphery side of the sector gear 42 is a locking structure using the locking piece 92*a* and the locking block 93 instead of a fastening means using a bolt. By locking the gear cover 92 and the gear case 93 on the outer periphery side of the sector gear 42, it is possible to prevent breakage of the locking between the pinion 37 and the gear portion 42*b* of the sector gear 42 from occurring when the sector gear 42 is inclined taking the support shaft 41 as a point of support upon rotating the pinion 37.

A bolt 94 as a fastening member is inserted into the bolt hole 92*a* provided at the middle portion of the gear cover 92. As illustrated in FIG. 12, the bolt 94 is inserted into the groove portion 42*c* of the sector gear 42 to penetrate the groove portion 42*c*, and is screw-coupled to a nut (not illustrated) attached to a back surface of the gear case 33. In this manner, the middle portion of the gear cover 92 is fixed to the gear case 33 by the bolt 94 penetrating the groove portion 42*c* of the sector gear 42 on a side closer to the support shaft 41 than the mesh portion of the pinion 37 and the sector gear 42.

In this manner, in the drive unit 93, in the same manner as the gear cover 51 of the drive unit 23 illustrated in FIG. 2, the gear cover 92 is fixed (supported) at its both sides to the gear case 33 interposing the mesh portion of the pinion 37 and the sector gear 42 by the locking structure of the locking piece 92*a* and the locking block 93 and the bolt 94 penetrating the groove portion 42*c* of the sector gear 42. And, the mesh portion of the pinion 37 and the sector gear 42 is covered by the gear cover 92.

As illustrated in FIG. 12, a pair of cover side pressing portions 92*c* and 92*d* are provided to a surface opposing the sector gear 42 of the gear cover 92. The cover side pressing portions 92*c* and 92*d* are integrally formed with the gear cover 92 in a rib shape protruding toward the sector gear 42 from the gear cover 92, respectively, and one of the cover side pressing portions 92*c* abuts a side surface of the sector gear 42 at a base portion of the gear portion 42*b* of the sector gear 42, i.e., in an outer periphery portion in a circular arc shape of the sector gear 42, and the other one of the cover side pressing portions 92*d* abuts a side surface of the sector gear 42 in an outer periphery portion of the attaching hole 42*a* of the sector gear 42. Meanwhile, as illustrated in FIG. 12, a pair of case side pressing portions 95*a* and 95*b* are provided to an outer surface of the gear case 33 opposing the sector gear 42. The case side pressing portions 95*a* and 95*b* extend like a circular arc around the support shaft 41 as a center, in the same manner as the case side pressing portions 62*a* and 62*b* illustrated in FIG. 4, and are formed in a rib shape protruding toward the sector gear 42 from the outer surface of the gear case 33. And, one of the case side pressing portions 95*a* abuts a side surface of the sector gear 42 to oppose the cover side pressing portion 92*c* at a base portion of the gear portion 42*b* of the sector gear 42, and the other one of the case side pressing portions 95*b* abuts a side surface of the sector gear 42 to oppose the cover side pressing portion 92*d* in an outer periphery portion of the attaching hole 42*a* of the sector gear 42. That is, the sector gear 42 has the base portion of the gear portion 42*b* being sandwiched by the cover side pressing portion 92*c* provided to the gear cover 92 and the case side pressing portion 95*a* provided to the gear case 33, and has an outer periphery portion of the attaching hole 42*a* being sandwiched by the cover side pressing portion 92*d* provided to the gear cover 92 and the case side pressing portion 95*b* provided to the gear case 33. In this manner, the sector gear 42 is pressed to the gear case 33 by the gear cover 92, and thus an inclination of the sector gear 42 taking as the support shaft 41 as a point of support is suppressed.

A supporting-shaft supporting hole 92*e* is provided to the other end of the gear cover 92, that is, an end portion in a longitudinal direction on a side being opposite to the side where the locking piece 92*a* is provided. A tip portion 47*a*, which is a tip of the shaft 47 inserted to the spouted portion of the support shaft 41 supporting the sector gear 42, is inserted into the supporting-shaft supporting hole 92*e*. Also, a tip portion 47*a* that is a tip of the shaft 47 is locked to the gear cover 92 by caulking not to drop out of the supporting hole 92*e*. In this manner, in the drive unit 91, an end of the support shaft 41 is supported by the base portion 33*b* of the gear case 33, and also the other end (tip) protruding from the base portion 33*b* is supported by the gear cover 92. In this manner, the support shaft 41 is supported at its both sides in the shaft direction interposing the sector gear 42, and thus the supporting rigidity is increased. Therefore, an inclination of the sector gear 42 around the support shaft 41 of the sector gear is suppressed, and the mesh accuracy of the sector gear 42 and the pinion 37 is increased.

As illustrated in FIG. 13, a pinion supporting hole 92*f* is provided on one side of the gear cover 92 to which the locking piece 92*a* is provided, that is, between the locking piece 92*a* and the bolt hole 92*b*, and a boss 96 is fixed to the gear cover 92 concentrically with the pinion supporting hole 92*f*. The boss 96 is formed in a cylindrical shape and functions as a shaft bearing.

As illustrated in FIG. 12, a tip of the output shaft 35 protrudes to the outside in the shaft direction from the pinion 37, and the tip portion of the output shaft 35 protruding from the pinion 37 is inserted into the pinion supporting hole 92*f* and the boss 96 so as to be rotatably supported by the boss 96. In this manner, in the drive unit 91, an end of the output shaft 35 is supported by the main body portion 33*a* of the gear case 33, and also the other end (tip) protruding from the main body portion 33*a* is supported by the gear cover 92. In this manner, the output shaft 35 is supported at its both sides in the shaft direction interposing the pinion 37, and thus the supporting rigidity is increased. Therefore, the mesh accuracy of the pinion 37 fixed to the output shaft 35 and the sector gear 42 is increased.

Figure 15:
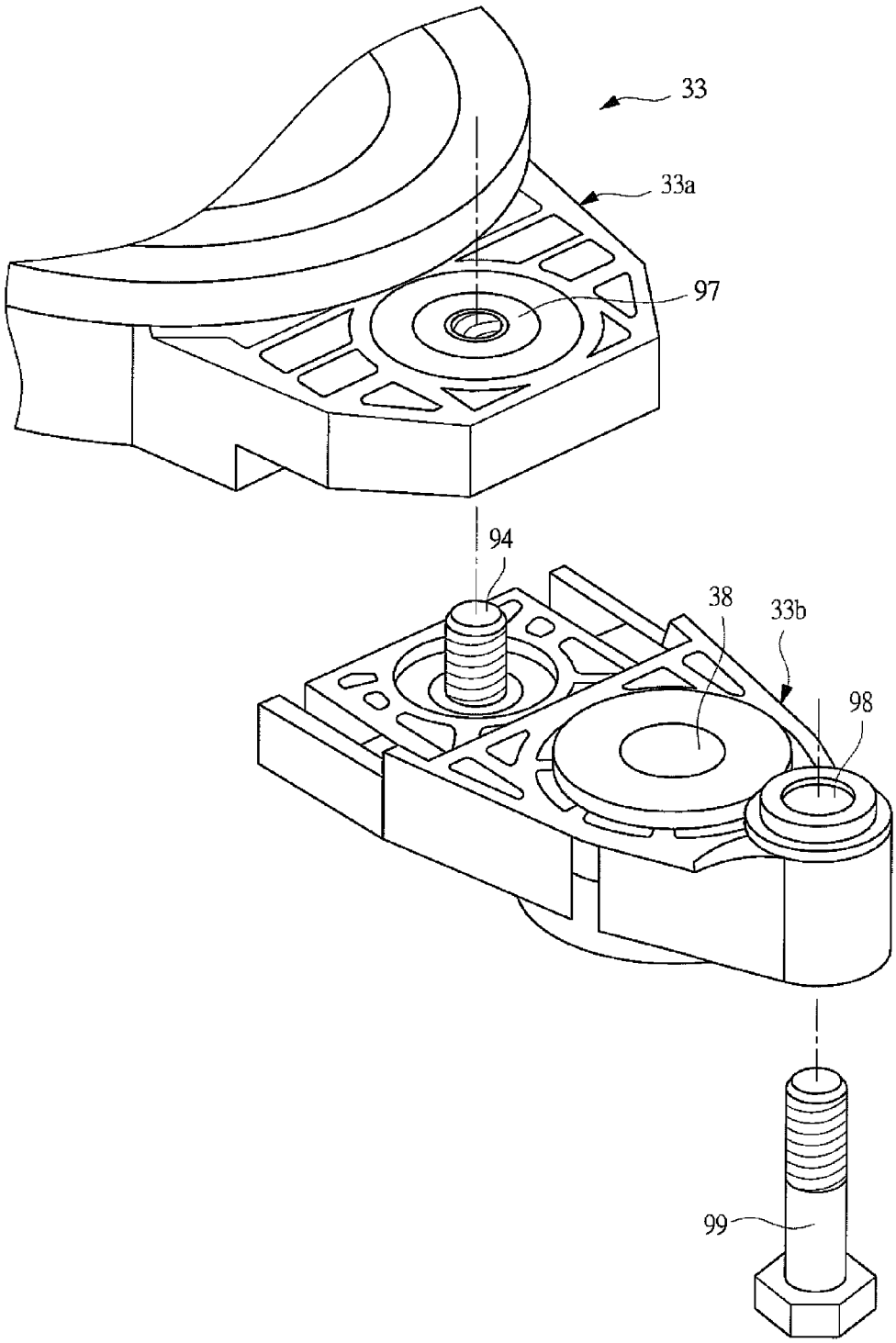
FIG. 15 is an exploded perspective view illustrating a modification example of a gear case illustrated in FIG. 11.

FIG. 15 is an exploded perspective view illustrating a modification example of the gear case illustrated in FIG. 11.

In the drive unit 23 illustrated in FIG. 2, the main body portion 33*a* and the base portion 33*b* of the gear case 33 are integrally formed of a resin material in the structure of the gear case 33. In contrast, in the drive unit 91 illustrated in FIG. 11, the main body portion 33*a* and the base portion 33*b* are separately formed of a resin material, respectively, and the gear case 33 is formed by assembling the main body portion 33*a* and the base portion 33*b*.

The main body portion 33*a* and the base portion 33*b* are assembled to each other at parts of themselves in a thickness direction (the shaft direction of the bolt 94). And, the main body portion 33*a* and the base portion 33*b* are fastened to each other by the bolt 94 for fixing the gear cover 92 to the gear case 33 as the main body portion 33*a* and the base portion 33*b* are being assembled to each other. That is, as illustrated in FIG. 15, the bolt 94 for fixing the gear cover 92 to the gear case 33 is inserted from the base portion 33*b* side, and a portion of the bolt 94 protruding from the base portion 33*b* is screw-coupled to a nut 97 disposed on the main body portion 33*a* side so that the structure has the main body portion 33*a* and the base portion 33*b* being integrally formed as being fastened by the bolt 94.

In addition, in the drive unit 23 illustrated in FIG. 2, as illustrated in FIG. 5, the bolt 58 disposed penetrating the groove portion 42*c* of the sector gear 42 for fixing the gear cover 51 to the gear case 33 is used together as a fastening member for fixing the drive unit 23 to the door 11.

In contrast, in the drive unit 91 illustrated in FIG. 11, the bolt 94 for fixing the gear cover 92 to the gear case 33 is not used together as a fastening portion for fixing the drive unit 92 to the door 11 in the structure. And, another bolt hole 98 is provided at a tip of the base portion 33*b* of the gear case 33, and the drive unit 92 is fixed by a bolt 99 inserted into the bolt hole 98 in the structure.

Figure 16:
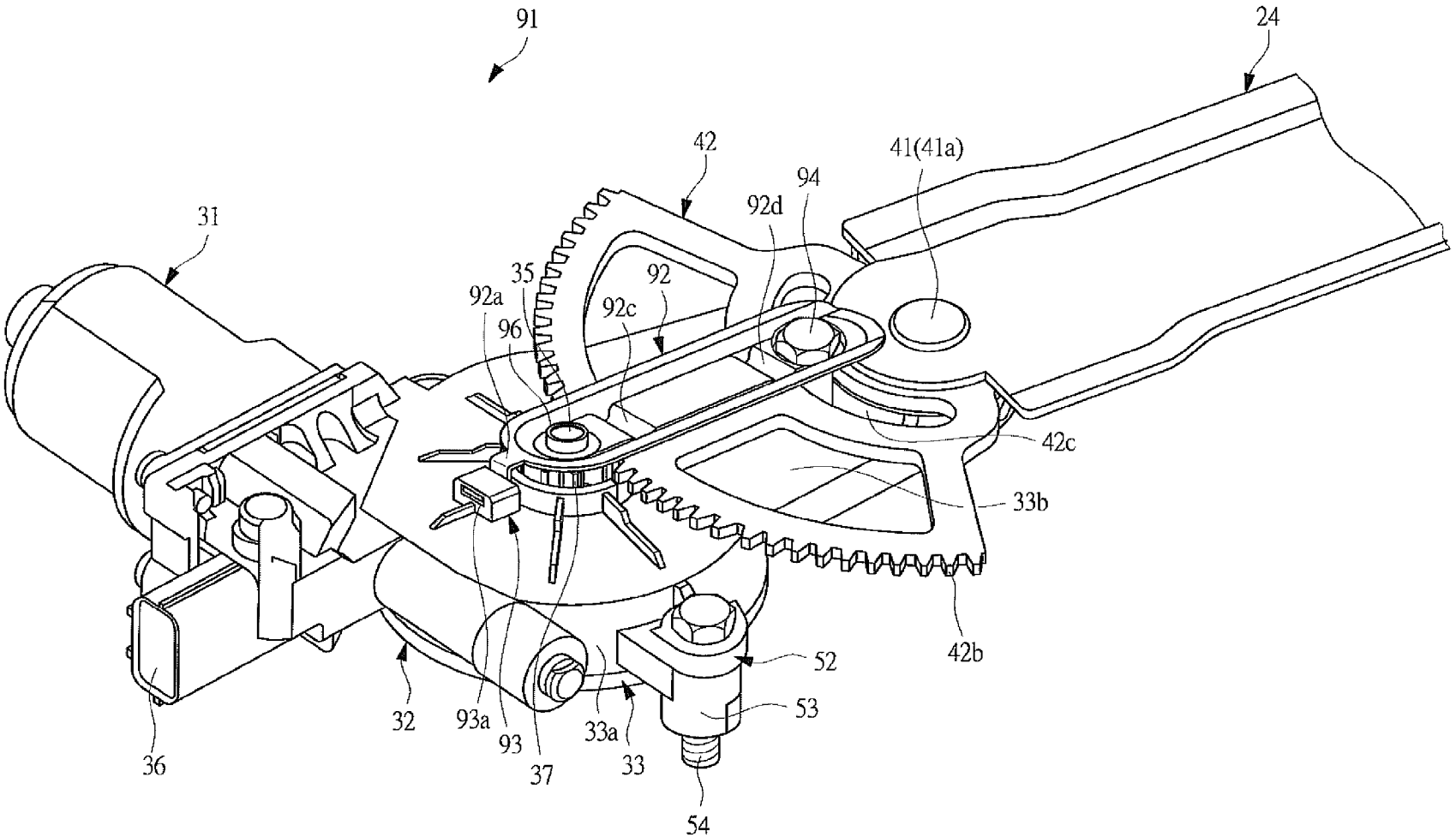
FIG. 16 is an exploded perspective view illustrating a modification example of the gear cover illustrated in FIG. 11.

FIG. 16 is an exploded perspective view illustrating a modification example of the gear cover illustrated in FIG. 11.

The gear cover 92 illustrated in FIG. 11 has the supporting-shaft supporting hole 92*e* at the other end of the gear cover 92, i.e., an end portion in a longitudinal direction on a side opposite to a side to which the locking piece 92*a* is provided, and the supporting shaft 41 is supported by the supporting-shaft supporting hole 92*e*. In contrast, as illustrated in FIG. 16, the gear cover 92 may be formed to be short and the supporting shaft 41 may not be supported in the configuration.

Note that, in FIGS. 11 to 16, members corresponding to those described above are denoted by the same reference numerals.

It is needless to say that the present invention is not limited to the foregoing embodiments and various modifications and alterations can be made within the scope of the present invention. For example, while descriptions have been made about the present invention applied to the power window apparatus 21 and the power tailgate 71 of a vehicle in the present embodiment, it is not limited to this and the present invention may be applied to another automatic opening and closing apparatus for vehicle as long as the present invention is applied to an automatic opening and closing apparatus for vehicle which automatically opens and closes an opening and closing body provided to a vehicle.

In addition, while the driven gear has been described as the sector gear 42 in a fan shape, it is not limited to this and a gear in a circular shape having a gear portion in the whole periphery may be used.

While the present invention has been illustrated and described with respect to a particular embodiment thereof, it should be appreciated by those of ordinary skill in the art that various modifications to this invention may be made without departing from the spirit and scope of the present.

The invention claimed is:

1. An automatic opening and closing apparatus for vehicle which automatically opens and closes an opening and closing body mounted on a vehicle, the automatic opening and closing apparatus for vehicle comprising:

an electric motor having a rotating shaft;

a gear case attached to the electric motor;

a worm gear mechanism which reduces speed of rotation of the rotating shaft and outputs the same from an output shaft;

a drive gear provided to the output shaft and rotated together with the output shaft, as being arranged outside the gear case;

a driven gear having a groove portion in a circular arc shape about a shaft center and engaged to the drive gear, as being swingably supported by a support shaft integrally provided with the gear case;

a drive arm provided with the driven gear and coupled to the opening and closing body at its tip so as to be swung together with the driven gear so that the opening and closing body is opened and closed; and a gear cover fixed to the gear case by a first fastening member penetrating the circular groove portion of the driven gear and a second fastening member arranged on an outer periphery side of the driven gear, the gear cover covering a mesh portion of the drive gear and the driven gear and having a cover side pressing portion abutting a side surface of the driven gear, wherein the gear cover is integrally formed with a cover side fixing leg, wherein the gear case is formed with a case side fixing leg corresponding to the cover side fixing leg, wherein the cover side fixing leg of the gear case is supported by the case side fixing leg of the gear case on the outer periphery side of the driven gear, and fixed by the second fastening member, wherein the gear cover abuts on one side surface of the driven gear, and the gear case abuts on the other side surface of the driven gear.

2. The automatic opening and closing apparatus for vehicle according to claim 1, wherein the drive arm and the driven gear are separately formed and a base end of the drive arm is fixed to the driven gear and swingably supported by the support shaft.

3. The automatic opening and closing apparatus for vehicle according to claim 2, wherein a pressing portion extended in a circular arc shape about the support shaft and protruding toward the driven gear is provided to the gear cover, and the pressing portion is abutted to the side surface of the driven gear.

4. The automatic opening and closing apparatus for vehicle according to claim 1, wherein a pressing portion extended in a circular arc shape about the support shaft and protruding toward the driven gear is provided to the gear cover, and the pressing portion is abutted to the side surface of the driven gear.

5. The automatic opening and closing apparatus for vehicle according to claim 1, wherein a tip of the support shaft is supported by the gear cover.

6. The automatic opening and closing apparatus for vehicle according to claim 1, wherein the first and second fastening members are bolts disposed on the gear cover side and screw-coupled to nuts disposed on the gear case side, and tips of the bolts serve as portions which are fixed to the vehicle after penetrating the nuts.

7. The automatic opening and closing apparatus for vehicle according to claim 1, wherein a bracket is integrally fixed to the gear case, and the driven gear is pivotally supported by a support shaft provided to the bracket, and also, the gear cover is fixed to the bracket by the first fastening member.

8. The automatic opening and closing apparatus for vehicle according to claim 7, wherein the gear cover and the driven gear are previously assembled and utilized, and the bracket is fixed to the gear case in a unitized state in which the gear cover and the driven gear are assembled and unitized.

9. The automatic opening and closing apparatus for vehicle according to claim 1, wherein the opening and closing body is a window glass mounted to be openable and closable in a vertical direction to a door of the vehicle, the electric motor is arranged inside the door having an axis direction of the drive gear toward a thickness direction of the door, and the drive arm is swung in the vertical direction inside the door to open and close the window glass.

10. An automatic opening and closing apparatus for vehicle which automatically opens and closes an opening and closing body mounted on a vehicle, the automatic opening and closing apparatus for vehicle comprising:

an electric motor having a rotating shaft;

a gear case attached to the electric motor;

a worm gear mechanism which reduces speed rotation of the rotating shaft and outputs the same from an output shaft;

a drive gear provided to the output shaft and rotated together with the output shaft, as being disposed outside the gear case;

a driven gear having a groove portion in a circular arc shape about a shaft center and meshed to the drive gear, as being swingably supported by a support shaft integrally provided with the gear case;

a drive arm integrally provided with the driven gear and coupled to the opening and closing body at its tip so as to be swung together with the driven gear so that the opening and closing body is opened and closed; and a gear cover locked to the gear case on an outer periphery side of the driven gear and also fixed to the gear case by a fastening member penetrating the groove portion, the gear cover supporting the support shaft and the output shaft, covering a mesh portion of the drive gear and the driven gear, wherein the gear cover abuts on one side surface of the driven gear, and the gear case abuts on another side surface of the driven gear.

11. The automatic opening and closing apparatus for vehicle according to claim 10, wherein the gear cover abuts the side surface of the driven gear at a pressing portion on cover side protruding toward the driven gear, and a pressing portion on case side protruding toward the driven gear and abutting the side surface of the driven gear is provided to the gear case.

12. The automatic opening and closing apparatus for vehicle according to claim 11, wherein the pressing portion on case side and the pressing portion on cover side oppose each other interposing the driven gear.

* * * * *